United States Patent [19]

Idei

[11] Patent Number: 4,768,468

[45] Date of Patent: Sep. 6, 1988

[54] METHOD OF CONTROLLING A FLUIDIZED BED BOILER

[75] Inventor: Yasumasa Idei, Yamaguchi, Japan

[73] Assignee: Ube Industries, Ltd., Ube, Japan

[21] Appl. No.: 134,345

[22] Filed: Dec. 17, 1987

[30] Foreign Application Priority Data

May 26, 1987 [JP] Japan ..... 62-129212
Nov. 8, 1987 [JP] Japan ..... 62-200645

[51] Int. Cl.[4] ..... F22B 1/00
[52] U.S. Cl. ..... 122/4 D; 165/104.16
[58] Field of Search ..... 122/4 D; 165/104.16

[56] References Cited

U.S. PATENT DOCUMENTS

| | | | |
|---|---|---|---|
| 4,279,207 | 7/1981 | Wormser | 122/4 D |
| 4,499,857 | 2/1985 | Wormser | 122/4 D |
| 4,614,167 | 9/1986 | Bergkvist | 122/4 D |
| 4,716,856 | 1/1988 | Beisswenger et al. | 122/4 D |

OTHER PUBLICATIONS

"Mining Engineering", Article by James W. Bass, III, *Development Described for Fluidized Bed Combustion at TVA's 20-MW Pilot Plant,* Apr. 1986.

*Primary Examiner*—Edward G. Favors
*Attorney, Agent, or Firm*—Frank J. Jordan; C. Bruce Hamburg; Manabu Kanesaka

[57] ABSTRACT

A fluidized bed boiler is controlled by the processes of (1) setting a reference range of the installation height of the fluidizing medium and a reference range of the temperature of the fluidized bed within the fluidizing chamber; (2) sensing the installation height of the fluidizing medium, comparing the sensed height with the set reference range of the settled bed height, and supplying or discharging the fluidizing medium; (3) sensing the temperature of the fluidized bed, comparing the sensed temperature of the fluidized bed with the set reference range, re-setting the reference range of the fluidizing medium settled bed height at a higher height in accordance with the temperature difference by which the temperature of the fluidized bed exceeds the reference range, if any, and re-setting the reference range of the fluidizing medium settled bed height at a lower height in accordance with the temperature difference by which the fluidized bed temperature is below the reference temperature range, if any; and returning to the process (2).

3 Claims, 10 Drawing Sheets

METHOD OF CONTROLLING A FLUIDIZED BED BOILER

FIELD OF THE INVENTION AND RELATED ART STATEMENT

This invention relates to a method of controlling a fluidized bed boiler which performs fluidizing combustion of coal or the like, and more particularly to such method which is improved so as to minimize changes in the temperature of the fluidized bed even if the load may change.

As well known, a fluidized bed boiler supplies fuel continuously into fluidizing chamber and air through a distributor plate into the fluidizing chamber to combust fuel, fluidize a fluidizing medium, and perform heat exchange in heating tubes disposed within the fluidizing chamber. In this fluidized bed boiler, the installation height of the heating tubes and the quantity of charged fluidized medium are set such that the heating tubes are immersed in the fluidized bed.

In such boiler, the heating tubes are immersed in the fluidized bed and the boiler is operated in an area in which the overall heat transfer coefficient is not lowered even if the air flow rate is lowered, which is a feature of heat transfer of the fluidized bed. Therefore, even if the fuel supply quantity and air supply quantity are reduced and the combustion heat of fuel is lowered when the boiler load is lowered, the heat transfer coefficient and the heat transfer surface area are not substantially lowered. Therefore, the fluidized bed may rapidly lower in temperature and not be able to operate.

In contrast, if the fuel supply quantity and air supply quantity are increased when the boiler load is increased, the temperature of the fluidized bed may rapidly increase to thereby cause a trouble such as a clinkering of the fluidizing medium.

In order to cope with this, U.S. Pat. No. 4,279,207 discloses that when a boiler load increases, the quantity of a fluidizing medium increases, the contact area between the fluidized bed and heating tubes increases to thereby increase a heat quantity transferred from the fluidized bed to the heating tubes. It also discloses discharge of fluidizing medium when the load decreases (especially, column 10, lines 54–62 and column 11, lines 7–14).

U.S. Pat. No. 4,499,857 discloses especially in column 4, lines 53–60 and in column 6, lines 17–19 that the height of the fluidizing medium is controlled in accordance with the temperature of the fluidized bed.

*Mining Engineering,* page 244, right column, lines 12–19 and FIG. 7, published in U.S.A., April 1986, discloses that the height of the fluidized bed and the number of heating tubes immersed in the fluidized bed are changed in accordance with the load.

However, the above references do not disclose a method of controlling the height of the fluidized bed appropriately.

OBJECTS AND SUMMARY OF THE INVENTION

It is a first object of this invention to provide a method of controlling the height of such a fluidized bed appropriately.

It is a second object of this invention to provide a method of controlling a fluidized bed boiler in which fluctuations in the temperature of the fluidized bed are very small even if the load on the fluidized bed boiler may fluctuate.

This invention controls the fuel supply quantity and the primary air supply quantity in accordance with a load on the fluidized bed boiler to thereby change the height of the fluidized bed, and to control the number of the heating tubes immersed in the fluidized bed to maintain the temperature of the bed at a constant value, the settled height of the fluidizing medium being controlled by the following processes of:

(1) setting a reference range of the installation height of the fluidizing medium and a reference range of the temperature of the fluidized bed within the fluidizing chamber in accordance with the kind of solid fuel supplied to the fluidizing chamber and the pressure within the drum;

(2) sensing the installation height of the fluidizing medium within the fluidizing chamber, comparing the sensed height with the set reference range of the selected bed height, and supplying or discharging the fluidizing medium by the supplying or discharging means for the fluidizing medium so that the settled bed height falls within the reference range of the settled bed height;

(3) sensing the temperature of the fluidized bed within the fluidizing chamber, comparing the sensed temperature of the fluidized bed with the set reference range, re-setting the reference range of the fluidizing medium settled bed height at a higher height in accordance with the temperature difference by which the temperature of the fluidized bed exceeds the reference range, if any, and re-setting the reference range of the fluidizing medium settled bed height at a lower height in accordance with the temperature difference by which the fluidized bed temperature is below the reference temperature range, if any; and returning to the process (2) thereafter.

According to this invention, if the quantities of supplied air and fuel are decreased in accordance with, for example, a decrease in the boiler load, the height of the fluidized bed is lowered, so that the number of heating tubes immersed in the fluidized bed is decreased. In contrast, when the quantities of supplied air and fuel are increased in accordance with an increase of the load, the height of the fluidized bed is increased, so that the number of heating tubes immersed in the fluidized bed is increased. Therefore, the area of the heating tubes which the fluidizing medium contacts is changed in accordance with a change in the boiler load. Thus the overall quantity of heat transferred from the fluidized bed to the heating tubes is changed in accordance with a change in the load to thereby greatly reduce fluctuations in the temperature of the fluidized bed. Therefore, even if the boiler load may change, a stabilized operation of the fluidized bed boiler continues, Generally, in the fluidized bed boiler, the temperature of the fluidized bed changes in accordance with the type and particle diameter distribution of coal used even at the same load, the same excessive air rate, and the same settled bed height of fluidizing medium. In this invention, the fluidizing medium is supplied or discharged in accordance with a change in the temperature of the fluidized bed to control the settled bed height of the fluidized bed. Thus fluctuations in the temperature of the fluidized bed are reduced.

Therefore, according to this invention, even if the boiler load may fluctuate, fluctuations in the temperature of the fluidized bed are extremely small, and a very stabilized operation of the boiler is possible.

According to a method of this invention, even if the kind of solid fuel (for example, the kind of coal) may change to change the quantity of heat produced in the fluidized bed, or even if the fuel may be of such a type that embers such as shale will be accumulated on the bed, the fluidized medium is automatically supplied and discharged to thereby control the temperature of the bed at a constant value.

BASE DESCRIPTION OF THE DRAWINGS

PREFERRED EMBODIMENT

Figure 1:
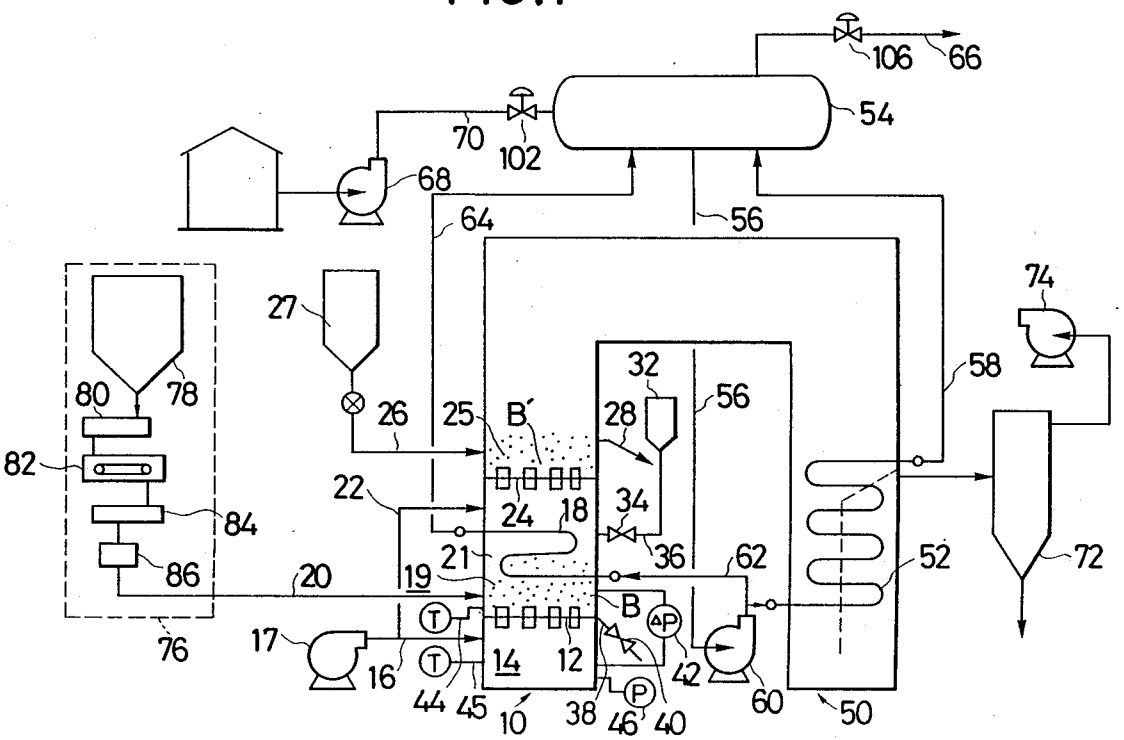
FIG. 1 is a view of a fluidized bed boiler system explaining an embodiment of this invention.
Figure 2:
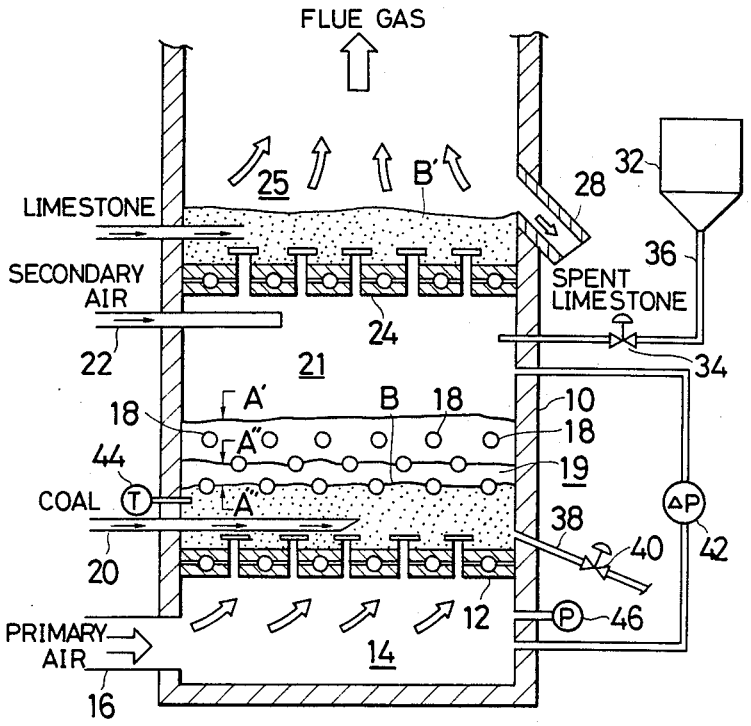
FIG. 2 is a cross-section view of the furnace of the boiler.

FIG. 1 is a view of a fluidized bed boiler system for explaining a method of controlling a fluidized bed boiler according to an embodiment of this invention. FIG. 2 is a cross-section view of a furnace.

Reference numeral 10 denotes a boiler furnace, on the inner bottom of which is provided a first distribution plate 12 extending across the boiler furnace to form an air chamber 14 to which is coupled a forced draft fan 17 via a primary air supply pipe 16. Provided above the distributor plate 12 is a first fluidizing chamber 19 in which are provided many heating tubes 18. In this embodiment, the heating tubes 18 are provided vertically in three stages and arranged in a staggered manner. Reference numeral 20 denotes a plurality of fuel supply tubes (for granular coal in this embodiment) provided immediately above the distributor plate 12 so as to ensure uniform supply of fuel.

A supply tube 22 is provided in the boiler furnace 10 to supply secondary air to a free board 21 above the heating tube 18. Provided above the secondary air supply tube 22 is a second distributor plate 24 extending across the boiler furnace, above which plate 24 is formed a second fluidized chamber 25 for desulfurization. Reference numeral 26 denotes a tube which supplies a desulfurizing medium such as limestone or dolomite from a bunker 27. Reference numeral 28 denotes a discharge pipe for discharging the limestone after desulfurization.

In order to supply a fluidizing medium to first fluidizing chamber 19, a fluidizing medium tank 32 is connected via a supply pipe 36 with a supply valve 34 to the first fluidizing chamber 19. In order to discharge fluidizing medium from the first fluidized chamber 19, an discharge pipe 38 with an discharge valve 40 is connected to the furnace 10. In addition, a differential pressure meter 42 which senses the differential pressure between the free board 21 and air chamber 14, a temperature sensor 44 which measures the temperature of the fluidized bed B in the fluidizing chamber 19, the temperature sensor 45 within the air chamber 14, and the pressure sensor 46 within the chamber 14 are provided.

Connected to the furnace 10 is a waste heat boiler 50 which has a heating tube 52 to which is connected a steam drum 54 via pipe 56 and 58. Provided midway in the pipe 56 is a circulating pump 60 whose discharge end is connected via a pipe 62 to one end of the heating tubes 18, the other end of which is connected via a pipe 64 to the steam drum 54. The steam drum 54 has a steam supply pipe 66 with a control valve 106 and receives soft water via a water feed pump 68 and a pipe 70. The pipe 70 has a flow control valve 102. Reference numeral 72 denotes a baghouse connected to the waste heat boiler 50 with an induced draft fan 74 provided downstream of the baghouse.

A coal feed device 76 includes a coal bunker 78, a rotary valve 80, a metering conveyor 82, a dryer 84, and a hammer crusher 86. Coal are transported pneumatically through the feed pipe 20 to the furnace 10.

In the above arrangement, a fluidizing medium is filled into the fluidizing chamber above the distributor plate 12, granular coal supplied from the feed pipe 20 is burnt with the aid of the primary air supplied via the air chamber 14 to form a fluidized bed B. The flue gas is then supplied with secondary air to pass through the second distributor plate 24 and enter the desulfurizing fluidized bed B′ for desulfurization. The gas is then subjected to heat exchange in the waste heat boiler 50, the dust of which is collected at the baghouse 72, and then discharged into the atmosphere.

The height of the installed heating tubes 18 is set such that when the height of the fluidized bed B is changed in correspondence to a change in the boiler load, the number of heating tubes 18 immersed in the fluidized bed B is changed. For example, when the boiler load becomes maximum, the quantities of supplied coal and primary air become maximum, the height of the bed B is increased to the level A′ in FIG. 2 so that all the heating tubes 18 are immersed into the bed B. When the boiler load is intermediate, the quantities of supplied coal and primary air are decreased correspondingly, the height of the bed B is lowered to the level A″ as shown, so that the uppermost one of the tubes 18 is exposed from the bed B. When the boiler load is minimum, the quantities of coal and primary air are reduced to their minimums, and the height of the bed B is lowered to the level A‴ as shown. Thus the uppermost- and intermediate-stage heating tubes 18 are exposed from the bed B, and the lowermost tubes 18 alone are imbedded in the bed B. Like this, when the height of the bed B is changed in accordance with a change in the boiler load, the number of heating tubes 18 immersed in the bed B is changed to thereby change the heat transfer surface area. Therefore, the total quantity of heat transferred from the bed B to the tubes 18 is changed in accordance with a change in the load, so that fluctuations in the temperature of the bed B are greatly reduced. In this way, even if the boiler load is lowered, a large amount of heat is exchanged to thereby avoid rapid lowering of the bed temperature, thereby ensuring stabilized boiler operation even in a low load condition.

The second fluidizing chamber 25 is supplied continuously with limestone grains from the pipe 26 to form a desulfurizing fluidized bed B′ therein. The limestone which has been spent to desulfurizing the flue gas which has passed through the fluidized bed B within the first fluidized chamber 21 overflows outside the furnace 10 from the pipe 28.

Figure 3:
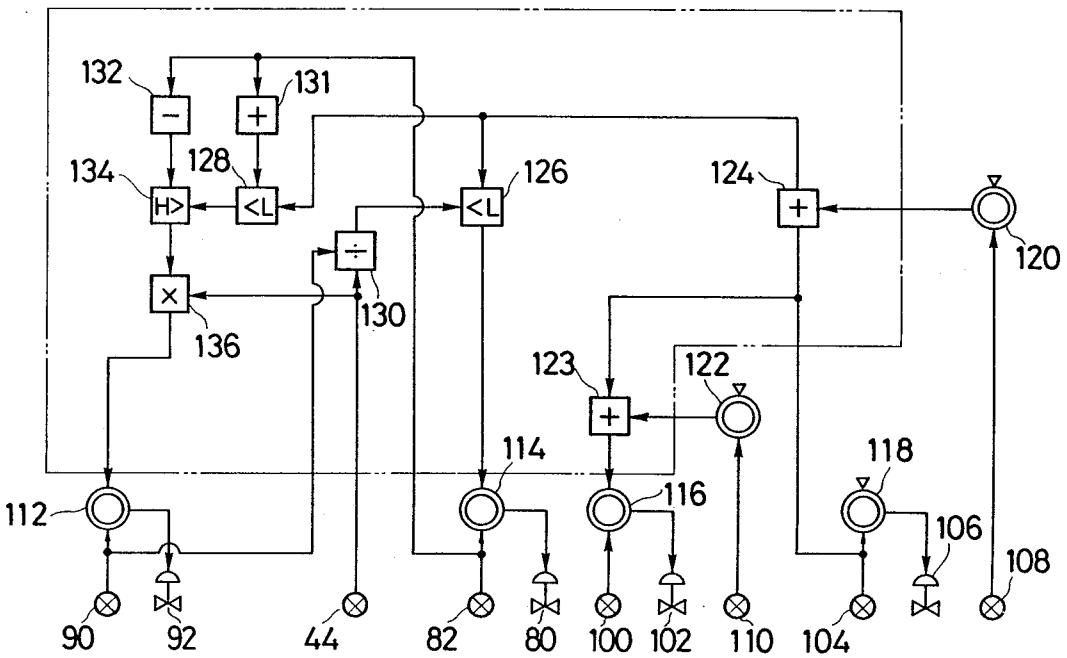
FIGS. 3 and 4 are control block diagrams.

The instrumentation of the fluidized bed boiler will now be described with reference to FIG. 3 which is a control block diagram.

The primary air supply pipe 16 is provided with a flow meter 90 and a flow control valve 92. An oxygen sensor 44 is provided in the furnace 10 for sensing the oxygen content therein. A coal supply system includes a metering conveyor 82 and a flow control valve 80 (rotary valve), and the water supply tube 70 is provided with a flow meter 100 and a flow control valve 102. The steam supply pipe 66 is provided with a flow meter 104 and a flow control valve 106, and the steam drum 54 is provded with a pressure meter 108 and a water level meter 110.

The signals from the flow meters 90, 82, 100 and 104 are input to regulators 112, 114, 116 and 118, respectively. The signals from the pressure meter 108 and water level meter 110 are input to regulators 120 and 122, respectively.

The level of the drum 54 is controlled as follows. Drum level regulator 122 and water supply flow regulator 116 are cascade controlled to improve the influence of fluctuations in the supplied-water pressure and in the characteristics of the water supply valve and to add at an adder 123 a main steam flow as a feed forward signal to the control output from the drum level regulator 122 to control the drum level by three elements (drum level, supplied-water flow, main steam flow).

The pressure control of the steam (main steam) supplied from the drum 54 is performed by automatic combustion control as follows.

The drum pressure regulator 120 is the center of the boiler control which controls the main steam pressure at a constant value and called a boiler master. The control output (master signal) from the boiler master 120 is added at an adder 124 to the main steam flow which acts as a feed forward signal from the flow meter 104 to improve the responsiveness during load fluctuations. Before entering air flow regulator 112 and coal flow regulator 114, the boiler master signal is compared with the quantity of air calculated from the coal flow and with the quantity of coal calculated from the air flow, and selection is made. Furthermore, in accordance with a signal from the oxygen sensor, band limits for a fuel set point and an air flow set point are calculated to thereby control the oxygen content to within a constant band. Namely, the boiler master signal from the adder 124 is input to low-signal selectors 126 and 128. The selector 126 is supplied with a calculated coal quantity signal from a computing unit 130, the calculated signal being obtained in accordance with the primary air quantity and the oxygen density in the furnace. The low-signal selector 126 selects the lower one of the coal quantities based on the boiler master signal and the signal from the computing unit 130 and outputs it to the regulator 114.

The signal indicative of the quantity of coal sensed by flow meter 82 is input to an adder 131 and a substacter 132 to set band limits and their output values are input to the low and high signal selectors 128 and 134, respectively, and compared with the boiler master signal to select the signal within the band limits. This selected signal is then output to computing unit 136, where a primary air quantity is computed based on the selected signal and the oxygen content in the furnace and the calculated result is output to the regulator 112. Thus, the quantities of air and coal are simultaneously controlled so that the oxygen content is within a predetermined range is spite of fluctuations in the boiler load.

In this invention, by changing a quantity of charged fluidizing medium, the height of the fluidized bed B in the first fluidizing chamber is controlled. For example, the temperature of the fluidized bed is changed depending on, for example, the kind and particle diameter distribution of coal even at the same load, the same excessive air rate and the same fluidizing medium charge quantity. The more volatile matter is contained, or the more fine particles are contained, the higher the percentage of matter burnt on the free board than in the fluidized bed is, so that the quantity of heat produced within the fluidized bed is reduced and the temperature of the bed B is lowered. When the temperature of the bed is lowered due to such causes, the fluidizing medium is discharged to lower the height of the bed B, the quantity of heat taken from the bed B is reduced and the temperature of the bed is returned to its original higher value.

In contrast, when the temperature of the bed B is elevated due to causes such as those mentioned above, the fluidizing medium is supplied to increase the height of the bed B to thereby increase a quantity of heat taken from the bed B to return the temperature of the bed to its original lower state.

Low-calorie coal such as debris contains much of rock components such as shale. Therefore, if such low-calorie coal is supplied to the boiler according to this invention, the rock components are accumulated on the bed B to increase the quantity of the fluidizing medium, so that the fluidizing medium must be discharged from the bed in order to maintain the height of the bed at a fixed value. At this time, it is control by a similar manner.

In order to perform such control, the pressure and temperature of the air chamber 14 are sensed, the primary air quantity for burning is sensed, and these data are calculated in accordance with a predetermined calculating equation, and the differential pressure with the distributor plate 12 in the combustion chamber is calculated. On the other hand, the differential pressure between the free board and the air chamber 14 is sensed by the differential pressure sensor 42. The differential pressure $\Delta P$ of the distributor plate 12 is subtracted from the output from the sensor 42, and the result is divided by the bulk specific gravity of the fluidizing medium to obtain the settled bed height of the charged fluidizing medium. The settled bed height of the charged fluidizing medium, temperature of the bed, and primary air quantity are calculated in accordance with a control equation of the fluidized bed temperature using a predetermined rearranged empirical formula as will be described later, and the quantities of supplied and discharged fluidizing medium are automatically controlled in accordance with the difference between the results and them.

The inference of the calculations, change of the kind of coal, etc., in these operations is performed using data stored in the data base for the computer, namely, using an expert system.

Figure 4:
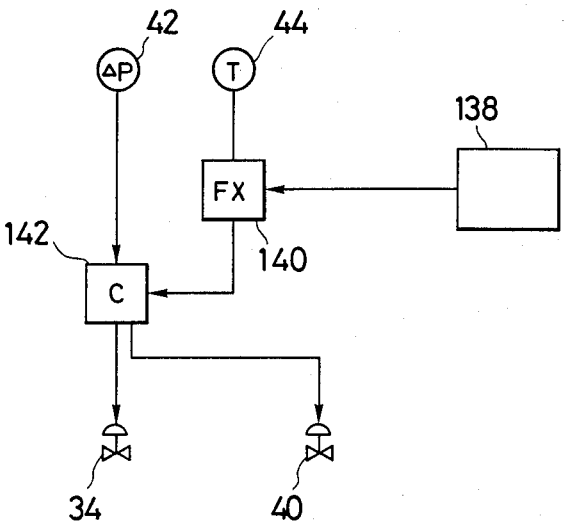

FIG. 4 is a block diagram for performing this control. Reference numeral 138 denotes a computor. Reference numeral 140 denotes a function generator which generates a function of the temperature of the bed B and data from the computor 138, and the function is supplied to a controller 142 which includes a built-in repeat type analogue computer. The controller 142 controls the fluidizing medium discharge valve 40 and fluidizing medium supply valve 34 on the basis of the differential pressure sensed by the differential pressure sensor 42, that function, the pressure P and temperature T1 of the air chamber, and the sensed temperature T of the bed B.

Figure 5A:
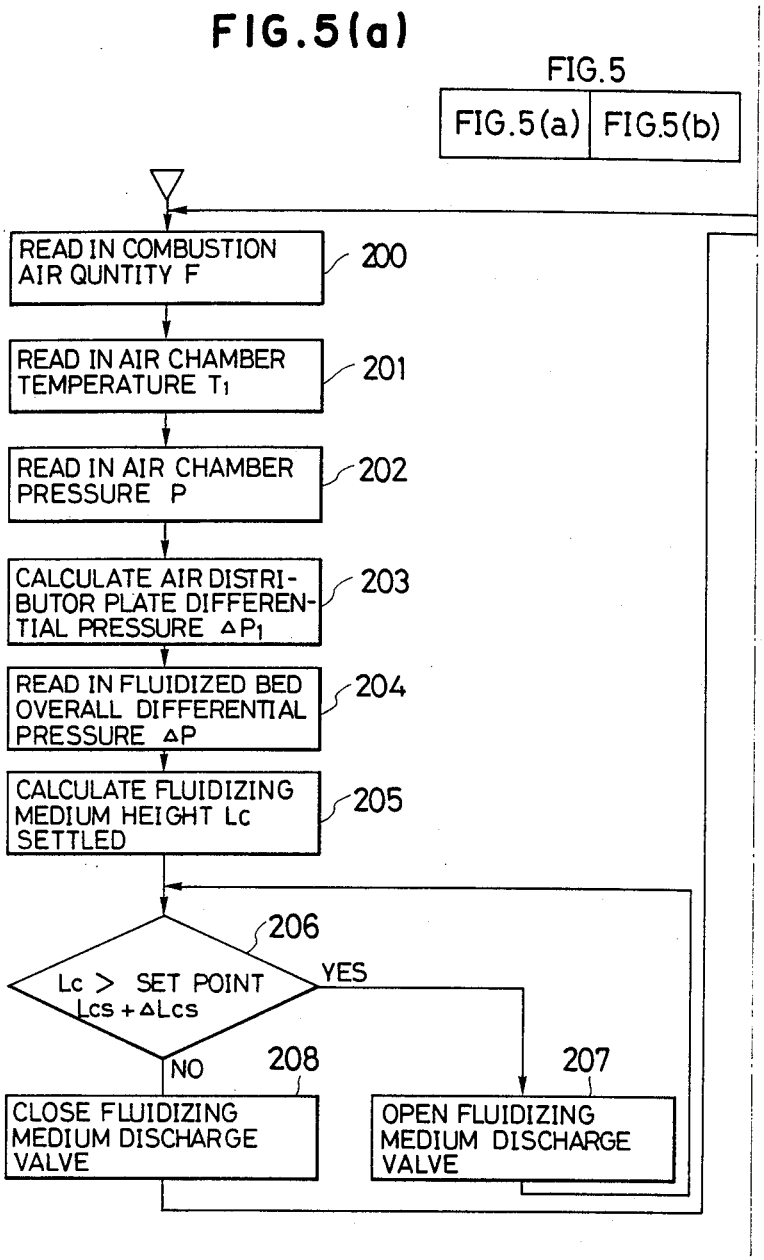
FIG. 5 is a flowchart explaining the control programs.
Figure 5B:
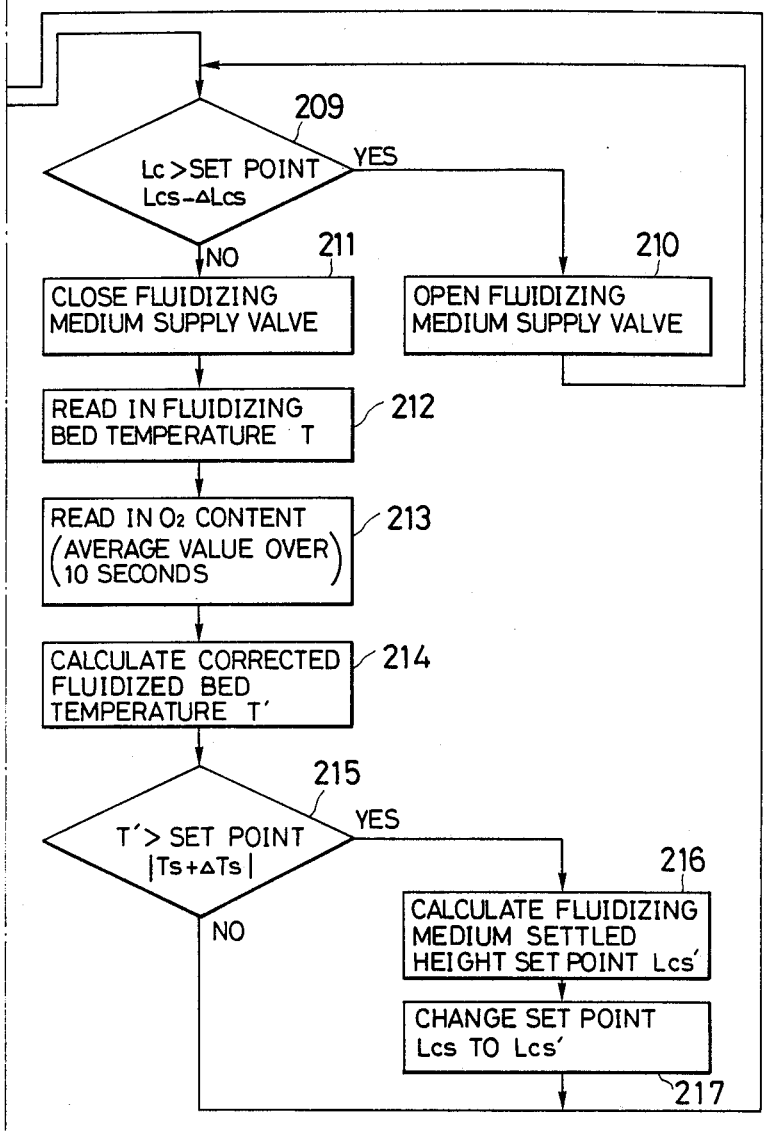

FIG. 5 is a flowchart for explaining the computer program of the controller 142.

The computer reads a quantity of primary air F for combustion, and the temperature T1 and pressure P of the air chamber 14 (steps 200, 201, 202), and calculates the differential pressure ΔP1 of the first distributor plate 12 in accordance with the following equations (1), (2), (3) (step 203)

$$\Delta P_1 = \frac{K1\ \rho a' V^2}{2g} \tag{1}$$

$$\rho' a = \rho a \times \frac{273}{273 + T1} \times \frac{1.033 + P}{1.033} \tag{2}$$

$$v = \frac{F \times \frac{273 \times T1}{273} \times \frac{1.033}{1.033 + P}}{A} \tag{3}$$

where K1 is a constant, g is a gravity acceleration, ρa is an air density, A is the total area of air pass holes in the first distributor plate 12.

Therefore, v is the flow velocity of air passing through the holes in the first distributor plate 12.

The differential pressure ΔP is read (step 204), and the settled bed height Lc of the fluidizing medium constituting the fluidized bed B is calculated in accordance with the following equation (4) (step 205), $$Lc = \frac{P - \Delta P1}{\rho s} \tag{4}$$

where ρs is the bulk density of the fluid medium.

At step 206, it is determined whether the settled bed height Lc is higher than the upper limit Lcs+ΔLcs of a reference range (Lcs±ΔLcs). If Lc is equal to, or larger than, the upper limit value Lcs+ΔLcs, a shift is made to step 207, where the fluidizing medium discharge valve 40 is opened to start discharge of the fluidizing medium. Steps 206 and 207 constitute a closed loop so that discharge of the fluidizing medium continues until the settled bed height Lc of the fluidizing medium becomes low compared to the upper limit value Lcs+ΔLcs. When the settled bed height of Lc is lower than the upper limit value Lcs+ΔLcs, a shift is made to step 208, where if the discharge valve 40 is open, it is closed and a shift is made to step 209, where it is determined whether the settled bed height Lc is higher than the lower limit value Lcs−ΔLcs of the reference range. When Lc is equal to, or lower, than Lcs−ΔLcs, a shift is made to step 210, where the fluidizing medium supply valve 34 is opened to supply a fluidizing medium. Steps 209 and 210 constitute a closed loop so that until Lc is higher than Lcs−ΔLcs, supply of the fluidizing medium continues. When Lc is higher than the lower limit value Lcs31 ΔLcs, a shift is made to step 211, where when the valve 34 is open, it is closed. The temperature T of the fluidized bed and the oxygen content (the average content over a relatively long interval, for example, of 10 seconds) are read (steps 212 and 213).

At step 214 the temperature of the bed is corrected with the oxygen content. The corrected temperature T′ is calculated in accordance with the following equation (5)

$$T' = K2 \times \left(\frac{21 - O_2}{21}\right) F^m \tag{5}$$

where K2, m are constants and $O_2$ is the oxygen content.

A shift is then made to step 215, where it is determined whether the corrected temperature T′ is within the reference range Ts±ΔTs. If so, a return is made to step 200. If T′ is outside the reference range, a shift is made to step 216, where the settled bed height Lcs of the fluidizing medium employed as a new reference is calculated and the old Lcs value is replaced with the new Lcs value (step 217) and a return is made to step 200.

The new Lcs is calculated by the following equation (6).

$$Lcs' = \frac{K4 \cdot T' + K5}{T' + K3} \cdot Lcs \tag{6}$$

where Lcs′ is the new reference value, Lcs is the old value, and K3, K4 and K5 are constants.

In the equations (1), (2), (3), (4), (5) and (6), the coefficients K2, K3, K4, K5 and m change in accordance with the fuel ratio, particle diameter distribution, overall water content ratio, and ash content ratio of particular coal. If the values obtained by simulation calculation using a rearranged empirical formula to be described later for each kind of coal are substituted into the above equations, stabilized control is possible with the same kind of coal by the control shown in this flowchart. Since the fluidizing medium has a large thermal capacity, the on-off control within a certain temperature band will suffice the control of the bed temperature. Thus even if the quantity of heat produced on the fluidized bed is changed due to a change of a kind of coal used, or even if a kind of coal used accumulates its components such as shale on the bed, the bed temperature can be automatically controlled. Further, in the case of regular coal, it is only required to feed a quantity of coal for that of the fluidizing medium wore and scattered, so that supply and discharge of sand are not performed even for once in a week and control is possible only by changing the quantities of air and coal in accordance with a change in the load. The kind of coal will be changed once per month, and the frequency of sand being supplied and discharged is low.

While in the illustrated embodiment, the heating tubes 18 are disposed vertically in three stages, they may be disposed in two, four or more stages according to this invention. While the illustrated fluidized bed boiler has a desulfurizing fluidized bed, this is not a requisite for this invention.

While in the above embodiment, coal grains are used as fuel, fine powdered coal or various combustibles other than coal may be used as fuel materials.

Although not especially limited in this invention, for example, it is preferably to select the settled bed height of the fluidizing medium between 150 and 300 mm, the vertical pitch of the heating tubes between 80 and 170 mm, the diameter of heating tubes between 30 and 90 mm in outer diameter, and the center of the lowermost heating tube between 300 and 600 mm above the distributor plate.

A preferred embodiment will now be described.

In the illustrated apparatus, silica sand was used as the fluidizing medium and granular coal as the fuel. The air ratio of the primary air was 1.05, the air ratio of the secondary air was 0.17, and the total surface area of the heating tubes 18 was 3.5 $m^2$. The settled bed height of the fluidizing medium was 200 mm, the vertical pitch of the heating tubes 130 mm, the diameter (outer diameter) of the heating tubes 65 mm, the central position of the lowermost stage heating tubes 450 mm above the distributor plate 12, and the number of stages in which the heating tubes were set 3 (staggered arrangement). The temperature of the bed B was measured while changing the boiler load to various values and the results are shown in FIG. 6.

Figure 6:
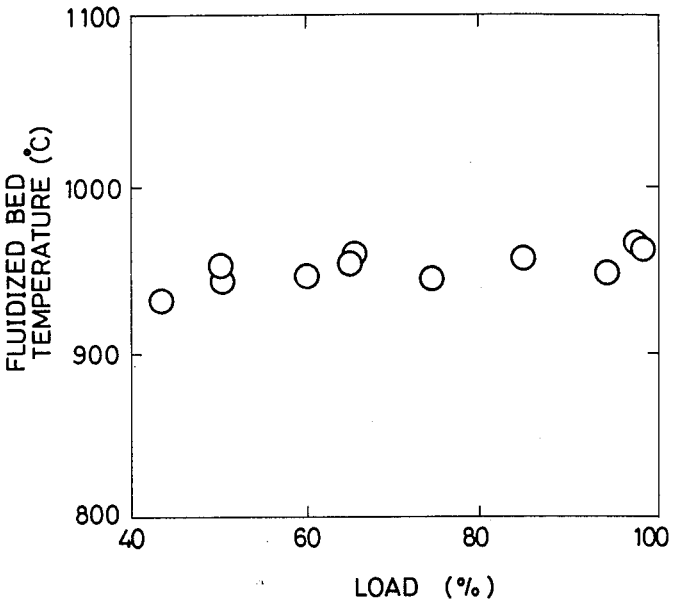
FIGS. 6 and 7 are graphs showing experimental results.
Figure 7:
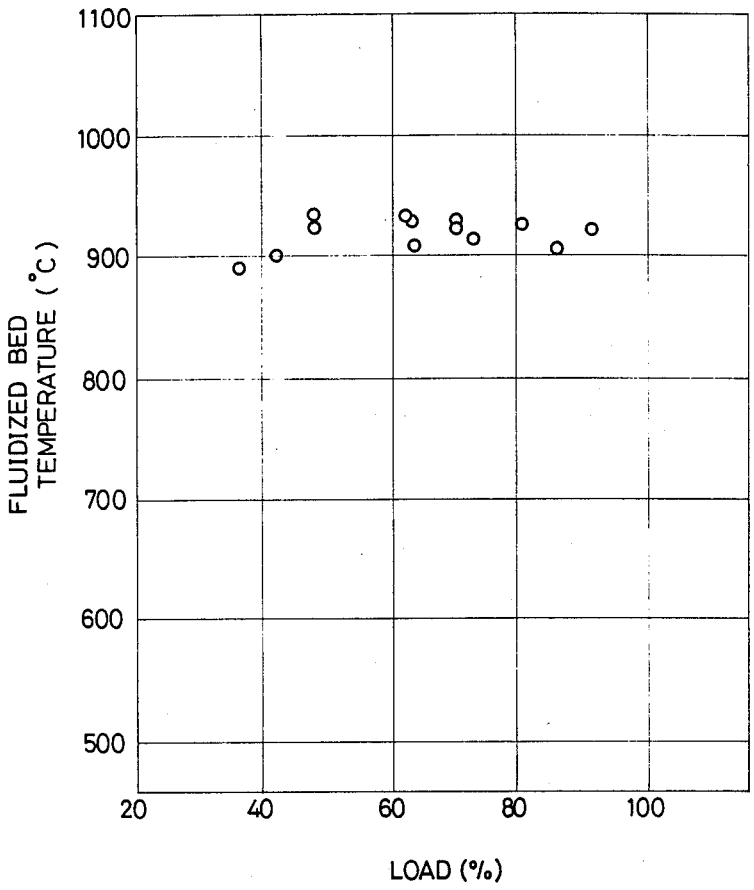

FIG. 7 shows the results of the measurement of the bed B temperature while the boiler load is changed under substantially the same conditions as those in FIG. 6 except that the total surface area of the heating tubes 18 was 65 $m^2$.

In FIGS. 6 and 7, according to this invention, it will be seen that the temperature of the fluidized bed does not substantially change, namely, is substantially constant, even if the boiler load may change. Concerning the results shown in FIGS. 6 and 7, the temperature of the fluidized bed tends to decrease when the load is lower than about 40% because it is necessary to intend stabilized fluidization by maintaining the minimum quantity of the primary air.

In the method of controlling a fluidized bed boiler according to this invention, it is necessary to know the respective quantities of heat transferred by the heating tubes having different heights on the basis of the quantity of charged fluidizing medium and the quantity of supplied air in order to determine the optimal values of height of the installed heating tubes. The inventors have obtained a rearranged empirical formula by which the average heat transfer coefficient of the heating tubes installed at a certain height can be obtained from the quantity of charged fluidizing medium and the quantity of supplied air using a method of heating air at room temperature by electric heater heating tubes in a rectangular fluidized bed experimental device heating a 450 mm square bed size to measure the heat transfer coefficient. The formula is shown below. The heating tube are disposed in three rows in a staggered manner, the diameter of each heating tube is 48 mm. The fluidizing medium is silica sands having an average particle diameter of 1 mm, and Umf=0.46 m/s, $$Z = \frac{1}{1 + Ay^n}$$

where $$Z = \frac{Hx - H\infty}{Hmax - H\infty}$$

$$Y = \frac{X - Lc}{Lc}$$

$A = 163\ e^{-4.0\ Ud}$ $n = 1.67 + 1.87\ Ud$ $Ud = Uo - Umf$

Figure 8:
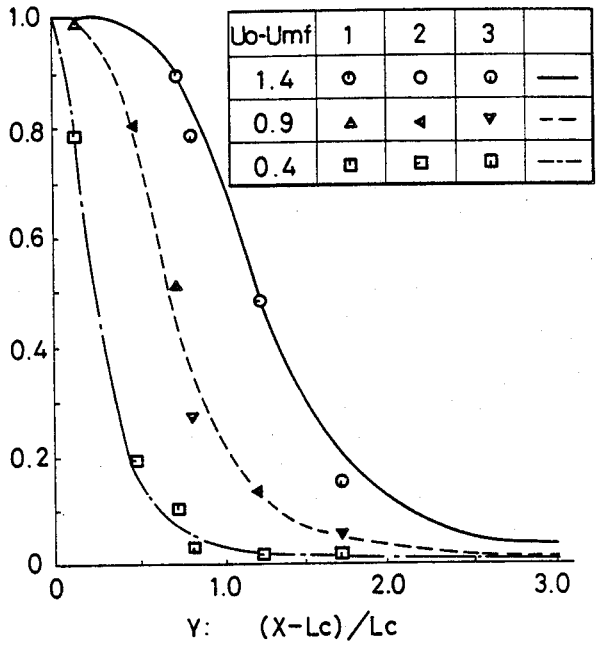
FIG. 8 is a graph showing the relationship between Z and Y.

Hx: the average heat transfer coefficient of the tube row at a height of x, $H\infty$: the average heat transfer coefficient of the tube in a single-phase compulsive convection, Hmax: the maximum value of Hx at each air superficial velocity, Lc: the settled bed height of the fluidizing medium, Uo: the air superficial velocity, Umf: the minimum fluidizing velocity, and x: the height from the distributor plate to the center of the heating tubes, FIG. 8 shows experimental values on the relationship between Z and (X−Lc)/Lc and the calculated values from the above rearranged formula. As shown in FIG. 8, the experimental data and the rearranged formula coincide well.

In order to apply the above empiricial formula to the actual device at high temperature, the relationship between the installation position of the heating tubes and the average heat transfer coefficient is calculated by calculating Hmax, using a published formular on the maximum heat transfer coefficient at elevated temperature for the horizontal heat transfer tubes within the fluidized bed. On the other hand, a quantity of heat exchanged at the heating tubes is calculated to obtain a predetermined fluidized bed temperature by calculating the heat balance from the burning percentages within and without the fluidized bed changing in accordance with the stoickiometric burning temperature changing depending on the composition of the fuel used, and the composition, combustiveness and particle diameter of the fuel. A change in the average heat transfer coefficient to maintain the predetermined fluidized bed temperature at a constant value within the fluctuating limit in the air supply quantity corresponding to the fluctuating limit of the load is calculated from the just calculated exchanged heat quantity. The quantity of charged fluidizing medium and the installation height of the heating tubes corresponding to the manner in which the average heat transfer coefficient changes are optimal values.

Figure 9:
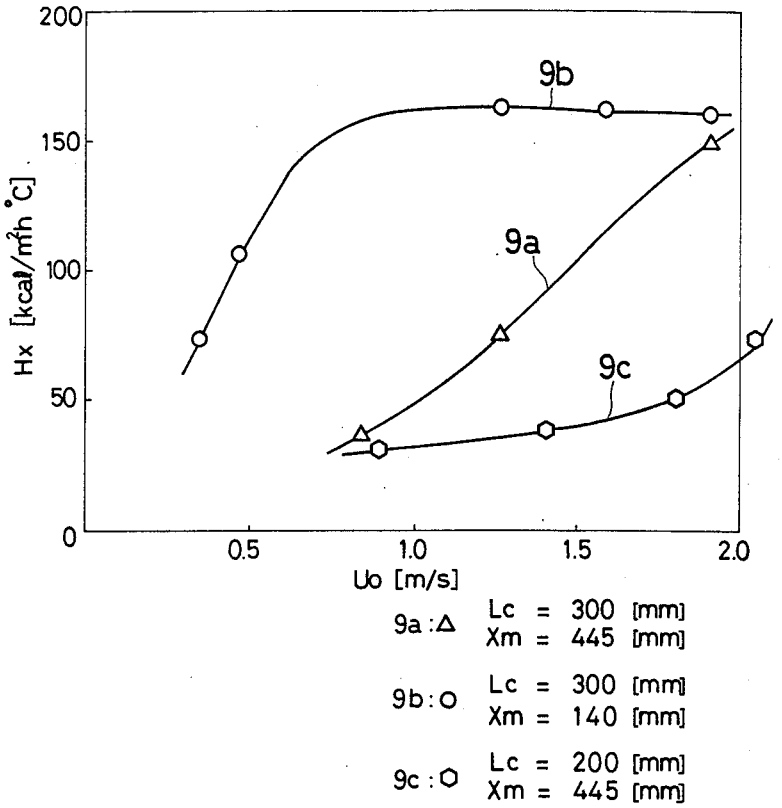
FIG. 9 is a graph showing the relationship between Hx and Uo.
Figure 10:
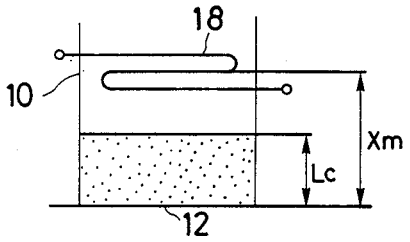
FIG. 10 is a schematic view showing Lc and Xm.

The line 9a of FIG. 9 shows the manner in which the desired average heat transfer rate Hx changes and is proportional to the air superficial velocity Uo, as shown by the experimental results obtained from the fluidized bed experimental device having 450 mm square bed size. In this case, the optical stationary bed height Lc=300 mm and the optical average installation height Xm of all the heating tubes=445 mm. Note that FIG. 10 is a schematic view showing Lc and Xm.

According to this method, when low-calorie fuel and/or a very high-volatile content fuel are burnt, or even if the fuel may change, the position of the heating tubes and the quantity of charged fluidizing medium can be set appropriately. Thus the temperature of the fluidized bed can be maintained constant against load fluctuations.

What is claimed is:

1. A method of controlling a fluidized bed boiler comprising:

an air chamber to which a primary air supply device is connected;

a fluidizing chamber for burning fuel therein and provided above the air chamber, separated by a distributor plate from the air chamber, and supplied with air through the distributor plate;

a plurality of heating tubes provided within the fluidizing chamber and having different installation heights;

a drum connected to the heating tubes for supplying steam by separating steam from water;

means for supplying fuel to the fluidizing chamber;

means for supplying a fluidizing medium to the fluidizing chamber;

means for discharging the fluidizing medium from the fluidizing chamber;

whereby the fuel supply quantity and the primary air supply quantity are controlled in accordance with a change in the boiler load to thereby change the number of the heating tubes immersed in the fluidized bed within the fluidizing chamber, the method comprising the following processes of:

(1) setting a reference range of the installation height of the fluidizing medium and a reference range of the temperature of the fluidized bed within the fluidizing chamber in accordance with the kind of solid fuel supplied to the fluidizing chamber and the pressure within the drum;

(2) sensing the installation height of the fluidizing medium within the fluidizing chamber, comparing the sensed height with the set reference range of the settled bed height, and supplying and/or discharging the fluidizing medium by the supplying and/or discharging means for the fluidizing medium so that the settled bed height falls within the reference range of the settled bed height;

(3) sensing the temperature of the fluidized bed within the fluidizing chamber, comparing the sensed temperature of the fluidized bed with the set reference range, re-setting the reference range of the fluidizing medium settled bed height at a higher height in accordance with the temperature difference by which the temperature of the fluidized bed exceeds the reference range, if any, and re-setting the reference range of the fluidizing medium settled bed height at a lower height in accordance with the temperature difference by which the fluidized bed temperature is below the reference temperature range, if any; and returning to the process (2) thereafter.

2. A method of claim 1, wherein the solid fuel is at least one selected from the group consisted of coal, oil coke, wood waste, culm, combustible sludge and other combustible waste.

3. A method of claim 1, wherein the primary air quantity is controlled so that the oxygen content in the fluidized bed falls within a predetermined range.

* * * * *

UNITED STATES PATENT AND TRADEMARK OFFICE

CERTIFICATE OF CORRECTION

PATENT NO. : 4,768,468

DATED : September 6, 1988

INVENTOR(S) : Yasumasa Idei

It is certified that error appears in the above-identified patent and that said Letters Patent are hereby corrected as shown below:

Change Title page:

"[30] Foreign Application Priority Data

May 26, 1987 [JP] Japan .....62-129212
Nov. 8, 1987 [JP] Japan .....62-200645"

to

--[30] Foreign Application Priority Data

May 26, 1987 [JP] Japan .....62-129212
Aug. 11, 1987 [JP] Japan .....62-200645--

Signed and Sealed this

Twenty-fourth Day of January, 1989

*Attest:*

DONALD J. QUIGG

*Attesting Officer*

*Commissioner of Patents and Trademarks*